United States Patent [19]

Scherer

[11] Patent Number: 4,662,426

[45] Date of Patent: May 5, 1987

[54] INTERLOCK FORMING MEMBER USED IN METAL CASTING

[76] Inventor: John R. Scherer, 1251 S. Reynolds Rd., Apt. 175, Toledo, Ohio 43615

[21] Appl. No.: 693,034

[22] Filed: Jan. 22, 1985

[51] Int. Cl.[4] ..... B22C 7/00

[52] U.S. Cl. ..... 164/412; 164/239; 164/341

[58] Field of Search ..... 164/214, 218, 235, 237, 164/238, 239, 241, 243, 341, 387, 412, 236, 242, 244, 13, 213, 339, 379, 382

[56] References Cited

U.S. PATENT DOCUMENTS

| | | | |
|---|---|---|---|
| 1,100,943 | 6/1914 | Becker | 164/214 |
| 1,335,509 | 3/1920 | Kralund | 164/13 |
| 1,369,683 | 2/1921 | McTighe | 164/243 |
| 1,428,359 | 9/1922 | Christianson | 164/239 |
| 2,348,086 | 5/1944 | Miller | 164/13 |
| 2,382,053 | 7/1945 | Hagemyer | 164/241 |
| 3,022,553 | 2/1962 | Hines | 164/239 |
| 4,512,385 | 4/1985 | Uppgren | 164/341 |

FOREIGN PATENT DOCUMENTS

| | | | |
|---|---|---|---|
| 321311 | 5/1920 | Fed. Rep. of Germany | 164/243 |
| 284425 | 2/1928 | United Kingdom | 164/243 |

*Primary Examiner*—Nicholas P. Godici
*Assistant Examiner*—G. M. Reid
*Attorney, Agent, or Firm*—George R. Royer

[57] ABSTRACT

The subject of the invention is a one piece interlock forming member used in metal casting, comprising a tapered member adapted to fit in the match plate, which is used in the core or mold forming process in such metal casting operations; the subject interlock forming member comprises a cylindrical member with a conically shaped upper portion, constituting the male member, with a conically shaped chamber inside the lower cylindrical portion, such chamber constituting the female portion, and which interlock forming member shapes corresponding male and female interlocks in the drag and cope sections of the flask used in metal casting.

1 Claim, 5 Drawing Figures

INTERLOCK FORMING MEMBER USED IN METAL CASTING

DISCUSSION OF BACKGROUND OF INVENTION

The subject of the invention pertains to metal casting of all types, however, it has particular application to the various types of sand casting operations used in the industry. Irrespective of the type of casting process utilized, as discussed above, the eventual goal and ideal in metal casting is to produce a resultant casting of superior quality at an economical cost, and the invention herein is directed to this objective.

Production of castings of superior quality where are free of imperfections requires use of auxiliary support devices, such as chaplets, which must be used to preserve the integrity of the mold and maintain the core in proper situation. In this latter regard, interlocking devices are also used to help maintain the opposing mold shapes, in the cope and the drag, properly aligned when the molten metal is introduced into the mold cavity. Any misalignment of the opposing mold configurations will cause corresponding problems in the resultant casting, with resultant misalignment problems.

In order to prevent such misalignment problems in metal casting, interlocks are formed in the surrounding sand portions of the cope and drag respectively. More particularly, one or more male members are formed in the drag portion adjacent its sand mold configuration and one or more female members are formed in the cope portion adjacent its sand mold. A male interlock member is adapted to fit conformingly into a mating female interlock member so as to lock the cope and drag sand portions together so the cope and drag portions do not become misaligned relative to one another during the casting process.

Most interlock forming members, as fitted in the match plate, are generally comprised of two separate members for the male and female portions respectively, with resultant loss of economy in use, manufacture, and handling. This invention is conceived for the purpose of using a unitary member functioning as an integrated interlock forming member to overcome these indicated problems.

OBJECTS

In view of the above discussion, it is an object of the subject invention to provide an improved interlock forming member for metal casting operations;

Yet another object of the subject invention is to provide an improved process in metal casting;

Still another object of the subject invention is to provide an improved interlock forming member as used in metal casting operations;

Yet another object of the subject invention is to provide improved processes for producing interlocks of superior quality as used in metal casting;

Still another object is to provide an efficient interlock forming member in metal casting operations;

A further object of the subject invention is to provide an efficient process for production of interlocks used in metal casting;

Another object is to provide an improved interlock forming member which yields effective support during the casting process;

Still another object of the subject invention is to produce a uniform interlock forming member as used in metal casting operations.

Other objects will become manifest from an examination of the drawings in connection with the specification, said drawings being described below.

DESCRIPTION OF PREFERRED EMBODIMENT

Description of the preferred embodiment of the subject invention will entail only a description of two embodiments, as set forth below, however, it is to be understood that the scope of the subject invention is not to be considered limited to such described embodiments as other embodiments are conceived as being within the scope of the subject invention.

Figure 1:
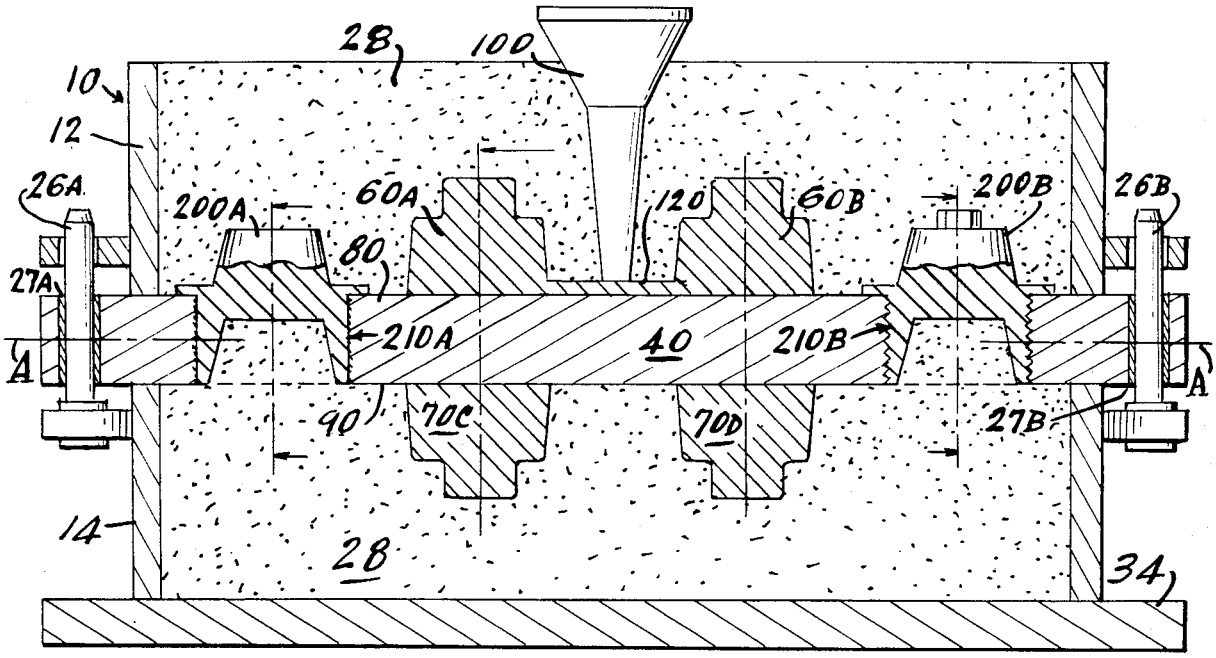
FIG. 1 is a side elevational view in section, of a casting match plate showing how the subject interlocks are used.
Figure 2:
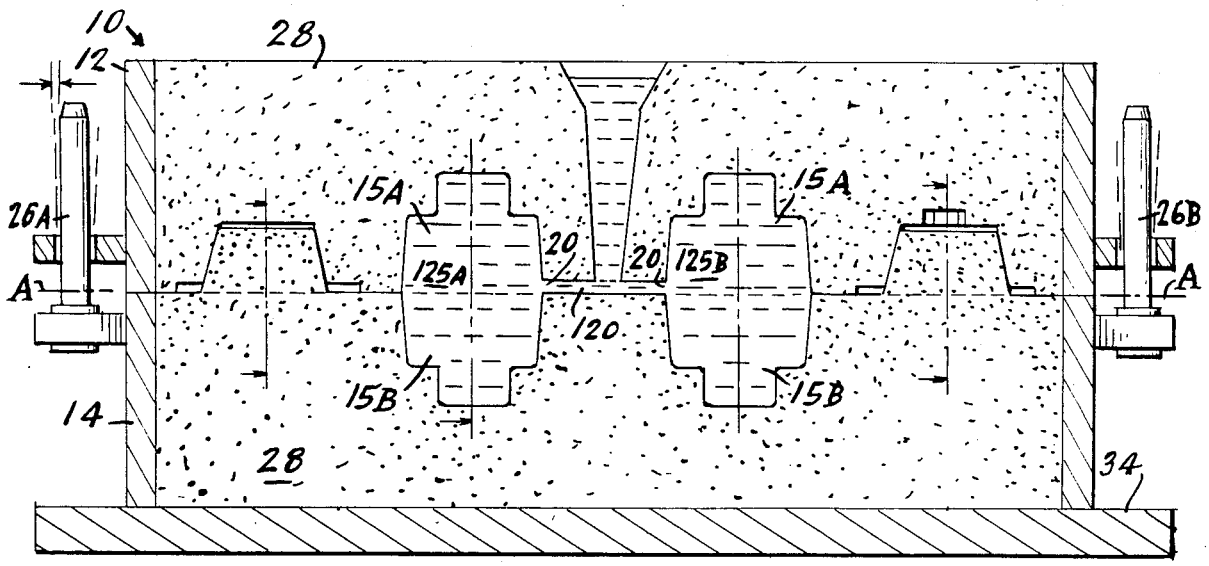
FIG. 2 is a side elevational view of the same view as in FIG. 1 after the match plate is removed.

Referring now to the drawings in order to describe the preferred embodiment of the subject invention, a sand casting flask apparatus 10 is shown in FIG. 1. Flask 10 is comprised of a cope 12 and a drag 14, representing the upper and lower portions respectively of the sand casting flask 10. More particularly, the cope 12 and drag 14 sections are generally of equal size and separable from one another. The cope 12 and drag 14 function to hold the upper portion 15A and lower portion 15B respectively of a mold cavity 20, as shown in both FIGS. 1 and 2 respectively. As represented in FIGS. 1 and 2 the cope 12 and drag 14 are separable independent units being juxtaposed along horizontal line A—A, with their lower surface and upper surface respectively being flush against one another. The cope 12 and drag 14 are secured to one another by hardened pins 26A and 26B located in bushings 27A and 27B respectively, as shown. Sand 28 is interspersed as the supporting medium in both the cope 12 and the drag 14, with the mold patterns being formed in the sand. On the bottom of the flask 10 is positioned a base board 34, which serves as the basic support member for the flask 10.

In order to form the mating mold impressions in the cope 12 and drag 14 respectively to form the mold cavity 20, a metallic match plate member 40 of rectangular disposition is used. Specifically, match plate member 40 is placed longitudinally and horizontally in the position shown in FIG. 1, and along axis A—A, to form the respective mold impressions 15A and 15B, for mold cavity 20, in the cope 12 and drag 14 respectively. For accomplishment of this purpose, the matching plate 40 is formed with mirror image three dimensional configurations for the mold cavity portions for the cope 12 and drag 14 positions respectively. Specifically, the match plate has three dimensional formations 60A and 60B on its upper surface 80 and dimensional formations 70C and 70D on the lower surface 90 of the matching plate member 40, as used to form the entire mold cavity 20. These respective three dimensional formations 60A, 60B, 70C and 70D form the mold cavity sections 15A and 15B in the cope and the drag portions for formation of the entire mold cavity 20. These mold forming portions 60A, 60B, 70A and 70B are representative only as examples of the mold forming portions found on the matching plate member 40, as they can vary in shape and number depending on the casting desired.

When the matching plate member 40 is emplaced horizontally between the sand portions of the cope 12 and drag 14, as shown in FIG. 1, the mold cavity sections 15A and 15B are formed as intended, and once the matching plate 40 forms these respective mold indentation sections, the matching plate 40 is removed from the position shown in FIG. 1, with the opposing mold cavities 15A and 15B formed as shown in FIG. 2. The cope 12 and the upper part of the drag 14 are thence brought together to the positions flush against one another, along axis A—A, in the juxtaposed arrangement as shown in FIG. 2. In this latter disposition the resultant mold cavity 20 is made ready for the injection of the molten metal in the metal casting process, with the mating portions 15A and 15B of mold cavity 20 being aligned with one another, as shown in FIG. 2. It is critical that these mating portions 15A and 15B of the mold cavity 20 be precisely aligned to achieve the necessary casting quality, as discussed before.

Located within the cope section 12 of the flask 10 is circular funnel shaped sprue 100, which functions as a receptacle for molten metal to be poured into the mold cavity 20. Sprue 100 is positioned in a vertically upright disposition, serving to carry the molten metal downwardly to a horizontally disposed runner 120 which, in turn, transports the molten metal to the mold cavity 20 through entrance gates, not shown. The foregoing description of the sprue system herein is by way of example only, and this discussion is intended only to illustrate the physical equipment and processes utilized to inject molten metal into the mold cavity 20.

As can be seen in FIG. 1, the match plate member 40 is equipped with interlocking forming members 200A and 200B. As shown, the interlocking forming members are fitted through circular bores 210A and 210B, which bores are smooth on their respective inner circumferential periphery, and thus each such circular bore 210A and 210B is adapted to receive an interlock forming member, as more fully described below. It is to be noted at this point that the matching plate can be constructed and employed to hold any number of interlocking forming members, and the description and illustration of two interlocking forming members are by way of example only, with no intent to limit the numbers so used.

The subject invention comprises a one-piece interlock forming member 400 replacing the usual two separate pieces, in order to render the casting process more efficient. In the conventional arrangement there are separate male and female portions used to form the male and female interlock portions respectively. In this regard, the female interlock is generally formed in the cope 12, while the male interlock is emplaced in the drag 14, although such arrangement may vary in reciprocal fashion. In forming these interlocking members, the match plate 40 is conventionally equipped on its upper surface with a male member projecting upwardly to form a female indentation and a separate female member is formed in the matching plate 40 to create a corresponding male member in the drag portion of the flask. This latter arrangement constitutes the prior art.

Figure 5:
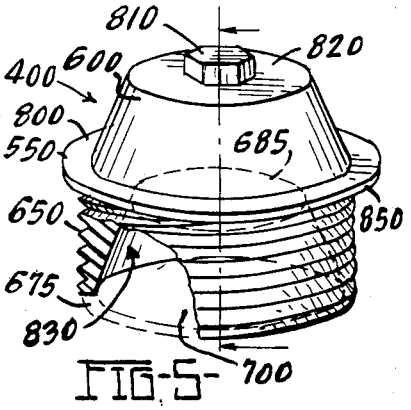
FIG. 5 is a perspective view of the subject interlock device showing the threaded member.

As seen in FIG. 5, and indicated above, the subject invention is an interlock forming member 400 comprising both male and female elements incorporated into one unit. Specifically, the interlock forming member 400 is basically a cylindrically shaped member 550 with a truncated conical member 600 integrally affixed to the upper portion thereof, as shown, in a concentric, coaxial member, as shown. The cylindrically shaped portion 550 has a threaded surface on its outer circumferential surface 650 so that the interlock forming member 400 can be screwed or fitted into one of the mating circular bores 210 or 210B in the matching plate 40, as shown in the drawings.

Figure 3:
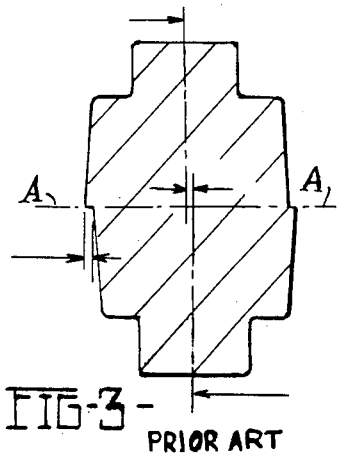
FIG-3- PRIOR ART
FIG. 3 is a side elevational view of a prior art interlock.

The bottom base portion 675 at the extreme bottom end of the interlock forming member 400 has a circular opening which communicates with an internal hollow member 700 of conical configuration with the largest circumferential area thereof at the base portion 675, with the smallest portion being disposed at the top-most part 685 of the conical chamber 700, as seen in FIG. 3.

As shown in the drawings, the upper portion of the interlock member 400 is a conical male member 600. Specifically, the lower base portion of the conical member 600 is integrally affixed to the upper solid circumferential surface 800 of the cylindrical portion 550 of the interlock member such that the largest diametric portion of the conical member 600 is affixed concentrically to the upper circumferential surface 800 of the bottom base member 550. The conical member 600 projects upwardly in a concentric manner and is truncated with an upper flat surface 820, as shown. As can be observed from a view of the drawings, the conical member 600 is of the same shape and size as the conically shaped hollow female chamber 700 in the bottom cylindrical portion 550. Thus, as can be seen, the conical portion 600 forms the male portion of the interlocking forming member 400, while the hollow chamber 700 forms the female portion. In this latter regard, the male portion 600 forms a conical female portion in the cope 12, while the female portion 700 forms a male member in the sand 28 of the drag 14.

More specifically, the interlock forming member 400 comprises both the male and female elements in the interlock formation process and is threaded into a bore 210A or 210B to form the mating male interlocks and female interlocks as used to keep the core and drag aligned.

Figure 4:
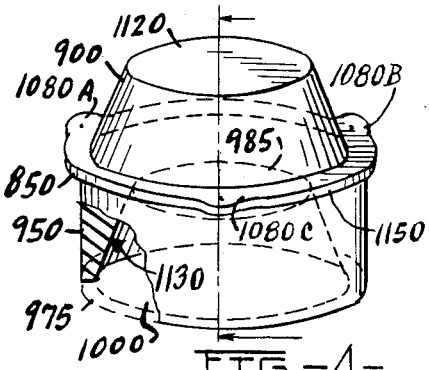
FIG. 4 is a perspective view of the subject interlock device.

In the embodiment shown in FIG. 4, an alternate arrangement is shown for an interlocking forming member 950 as shown in FIG. 5. In the embodiment seen in FIG. 5, a retaining rim 850 is used to secure the interlocking forming member 950 in position in the matching plate 40 in lieu of the use of a threaded exterior. In other respects, the interlocking forming member 950 is generally the same as the embodiment shown in FIG. 5.

It is to be understood that the foregoing is a description of a preferred method applied in sand casting, but that the principles can be used in other areas of metal casting also. Therefore, other uses are clear. The foregoing description of the specific application is not to be considered a limitation on the scope of the following claims.

I claim:

1. A one piece mold interlock comprising:

(a) a cylindrical member with a circular opening at one end, said opening being the opening to a chamber in said cylindrical member, and wherein the entire chamber is shaped as a truncated conical chamber and said truncated conical chamber is concentric to the cylindrical member, and wherein said circular opening is coextensive with the largest diameter end of said truncated conical chamber;

(b) a male member integrally attached to the cylindrical member at the end opposite the end having the circular opening, wherein the entire male member is shaped as a truncated conical member and said truncated conical member is concentrically aligned with the truncated conical chamber in the cylindrical member;

(c) a circular ledge extending radially outwardly from said cylindrical member at the end where the male member is attached; and wherein the conical chamber and the male member have substantially equal geometric dimensions such that said conical member can form a female cavity in a cope section of a sand mold and said conical chamber can form a male protrusion in a drag portion of said sand mold so that when the scope and drag sections are brought together the majority of the conical surfaces of said female cavity and said male protrusion come into mating contact and align said cope and drag sections.

* * * * *